US006904249B2

(12) United States Patent
Kato et al.

(10) Patent No.: US 6,904,249 B2
(45) Date of Patent: Jun. 7, 2005

(54) TONER CARTRIDGE AND IMAGE FORMING APPARATUS USING THE SAME

(75) Inventors: Yasuyuki Kato, Tokyo (JP); Junichi Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 12 days.

(21) Appl. No.: 10/446,231

(22) Filed: May 27, 2003

(65) Prior Publication Data

US 2003/0223776 A1 Dec. 4, 2003

(30) Foreign Application Priority Data

May 28, 2002 (JP) ..... 2002-153482

(51) Int. Cl.[7] ..... G03G 15/08; G03G 21/10; G03G 21/12

(52) U.S. Cl. ..... 399/120; 399/358; 399/360

(58) Field of Search ..... 399/120, 258, 399/260, 358, 359, 360, 262

(56) References Cited

U.S. PATENT DOCUMENTS 4,660,960 A * 4/1987 Fukunaga et al. ..... 399/258
5,084,734 A * 1/1992 Yoshino et al. ..... 399/360
5,781,841 A * 7/1998 Kouroku et al. ..... 399/360
6,021,292 A 2/2000 Nakajima et al.
6,339,689 B1 * 1/2002 Sugiura ..... 399/120
6,363,233 B1 3/2002 Nakajima
6,418,284 B1 * 7/2002 Mercer ..... 399/120

FOREIGN PATENT DOCUMENTS

| | | |
|---|---|---|
| JP | 59-184373 | 10/1984 |
| JP | 5-249766 | 9/1993 |
| JP | 63-298370 | 12/1998 |
| JP | 11-212344 | 8/1999 |

* cited by examiner

*Primary Examiner*—William J. Royer
(74) *Attorney, Agent, or Firm*—Akin Gump Strauss Hauer & Feld, LLP

(57) ABSTRACT

A toner cartridge has a first chamber that holds fresh, toner and a waste toner chamber that holds waste toner. The toner cartridge includes a partition that divides an inner space of the toner cartridge into the fresh toner chamber and the waste toner chamber. The partition is such that the fresh toner chamber and the waste toner chamber extend substantially in parallel with each other and are partially adjacent to each other horizontally. The partition operates in such a way that the fresh toner chamber decreases in volume and the waste toner chamber increases in volume with increasing amount of the waste toner in the waste toner chamber. The movable portion may be a deformable bag-shaped member. The fresh toner chamber may have a resilient flap therein to agitate the fresh toner.

26 Claims, 15 Drawing Sheets

TONER CARTRIDGE AND IMAGE FORMING APPARATUS USING THE SAME

BACKGROUND OF THE INVENTION

The present invention generally relates to a toner cartridge and an image forming apparatus.

DESCRIPTION OF THE RELATED ART

An image forming apparatus performs processes of charging, exposing, developing, transferring and fixing in sequence to record an image. The image forming apparatus includes a print process cartridge, which in turn includes a charging unit, a photoconductive drum, and a developing unit. A toner cartridge is detachably received in the print process cartridge and supplies toner to the developing unit. The charging unit charges the surface of the photoconductive drum uniformly. An exposing unit illuminates the charged surface of the photoconductive drum in accordance with print data to form an electrostatic latent image. The developing unit supplies toner to the electrostatic latent image to develop the latent image into a toner image. The toner image is transferred onto print paper by a transferring unit. Then, the print paper advances to a fixing unit where the toner image is fused into a permanent image. Toner that remains on the photoconductive drum after transfer is removed from the photoconductive drum and collected into a waste toner tank provided in the print process cartridge. However, the provision of a waste toner tank requires a space for housing the waste toner tank, leading to a large overall size of the image forming apparatus. Thus, a system is usually employed which collects residual toner into a toner cartridge so that the residual toner can be discarded together with the toner cartridge when the fresh toner in the toner cartridge has been exhausted.

However, a conventional toner cartridge requires a space that holds collected residual toner. This in turn reduces a space for holding fresh toner. As a result, when the toner cartridge is replaced, an amount of toner that can be replenished is small. This increases the cost of the toner cartridge per a predetermined number of printed pages. If a toner holding space is to be made larger, the overall size of the toner cartridge becomes large, leading to a larger overall size of an image forming apparatus.

BRIEF SUMMARY OF THE INVENTION

An object of the present invention is to provide a toner cartridge in which the replacement of the toner cartridge allows replenishment of as large an amount of fresh toner as possible and saving of the running cost of the image forming apparatus.

An object of the invention is to provide a toner cartridge that makes it possible to miniaturize an image forming apparatus.

A toner cartridge has a first chamber that holds fresh toner and a second chamber that holds waste toner. The cartridge includes a partition provided in the toner cartridge to divide an inner space of the toner cartridge into the first chamber and the second chamber. The partition operates in such a way that a volume of the second chamber increases in accordance with an amount of the waste toner in the second chamber.

The partition is such that the first chamber and the second chamber extend substantially in parallel with each other and are partially adjacent to each other horizontally.

The partition operates in such a way that the first chamber decreases in volume and the second chamber increases in volume.

The partition has a movable portion and a fixed portion that supports the movable portion. The second chamber has a waste toner inlet through which the second chamber receives the waste toner, the inlet being located under the movable portion.

The movable portion is a deformable bag-shaped member.

The bag-shaped member has a thickness in the range of 0.2 to 0.4 mm.

The second chamber has a swingable member therein. The swingable member is urged against the partition in such a way that the swingable member pushes the deformable bag-shaped member toward the first chamber.

The partition is detachably inserted into the toner cartridge.

The first chamber has a resilient flap extending in the first chamber.

The first chamber has an agitator bar that agitates the fresh toner in the first toner chamber. The resilient flap is a film. When the agitator bar agitates the fresh toner, the film moves into engagement with the agitator bar such that the film flexes and subsequently moves out of engagement with the agitator bar.

The second chamber extends in a longitudinal direction and has a first transport member therein that extends in the longitudinal direction of the second chamber and a waste toner inlet located at one of opposing ends of the second chamber. The first transport member transports the waste toner from the one of the opposing ends of the second chamber to another one of the opposing ends.

The first transport member has a spiral vane formed on it, the spiral vane extending from one end of the first transport member to a part of the first transport member.

The second chamber includes a second transport member therein for transporting the waste toner toward the waste toner inlet, the second transporting member extending above the first transport member in the longitudinal direction of the second chamber.

The partition operates to increase the second chamber in volume when the amount of waste toner exceeds a certain value.

In another aspect, the present invention is directed to an image forming apparatus having a toner cartridge as described above.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE SEVERAL VIEWS OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Preferred embodiments of an electrophotographic printer according to the invention will be described.

First Embodiment

Figure 1:
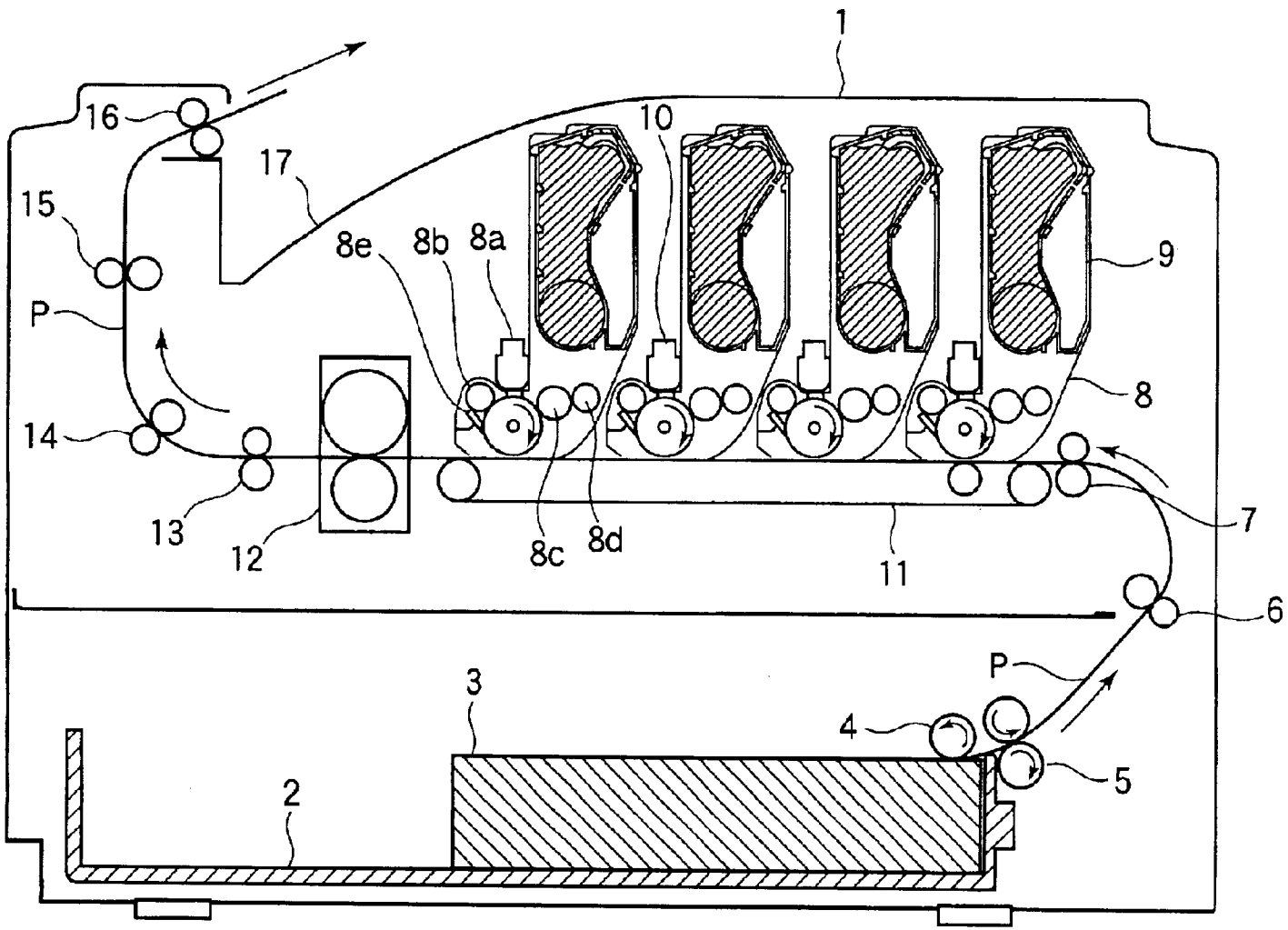
FIG. 1 is a cross-sectional view, illustrating a general configuration of a color electrophotographic recording apparatus according to the invention.

FIG. 1 is a cross-sectional view, illustrating a general configuration of a color electrophotographic recording apparatus 1 according to the invention. Referring to FIG. 1, a paper cassette 2 holds print paper 3 therein. A roller 4 feeds the print paper 3 into a transport path P from the paper cassette 2 on a page-by-page basis. Transport rollers 5, 6, and 7 transport the print paper 3 to print process cartridges 8. The print paper 3 advances to a transfer section of the print process cartridge 8 where a toner image is transferred onto the print paper 3. Then, the print paper 3 advances to a fixing unit 12 and then discharging roller 13, 14, 15 and 16 drive the print paper 3 into a paper stacker 17.

Four print process cartridges 8 are disposed along the transport path P of the print paper 3. The four print process cartridges 8 are of the same configuration and each of the four print process cartridges 8 forms a toner image of a corresponding color. Each print process cartridge 8 includes a photoconductive drum 8*a*, a charging roller 8*b*, a developing roller 8*c*, a toner supplying roller 8*d*, a toner cartridge 9, and a cleaning unit 8*e*. The photoconductive drum 8*a* is a photoconductive body driven in rotation by a drum motor, not shown. The charging roller 8*b* charges the surface of the photoconductive drum 8*a*. An exposing unit 10 illuminates the charged surface of the photoconductive drum 8*a* to form an electrostatic latent image. The toner cartridge 9 supplies toner to a developing unit. The toner supplying roller 8*d* in the developing unit supplies toner to the developing roller 8*c*, which in turn supplies the toner to the electrostatic latent image to develop the electrostatic latent image into a toner image. The cleaning unit 8*e* scrapes the toner off the photoconductive drum 8*a* to clean the photoconductive drum 8*a*. A transfer unit 11 has transfer rollers that face corresponding photoconductive drums 8*a* to define transfer points between the photoconductive drums 8*a* and the transfer rollers. When the print paper 3 passes each transfer point, a toner image of a corresponding color is transferred from the photoconductive drum 8*a* onto the print paper 3.

With electrophotographic recording apparatus, some of the toner remains on the surface of the photoconductive drum 8*a* after transfer. The residual toner on the photoconductive drum 8*a* is removed by the cleaning unit 8*e* and is collected into a waste toner chamber of the toner cartridge 9.

Figure 2:
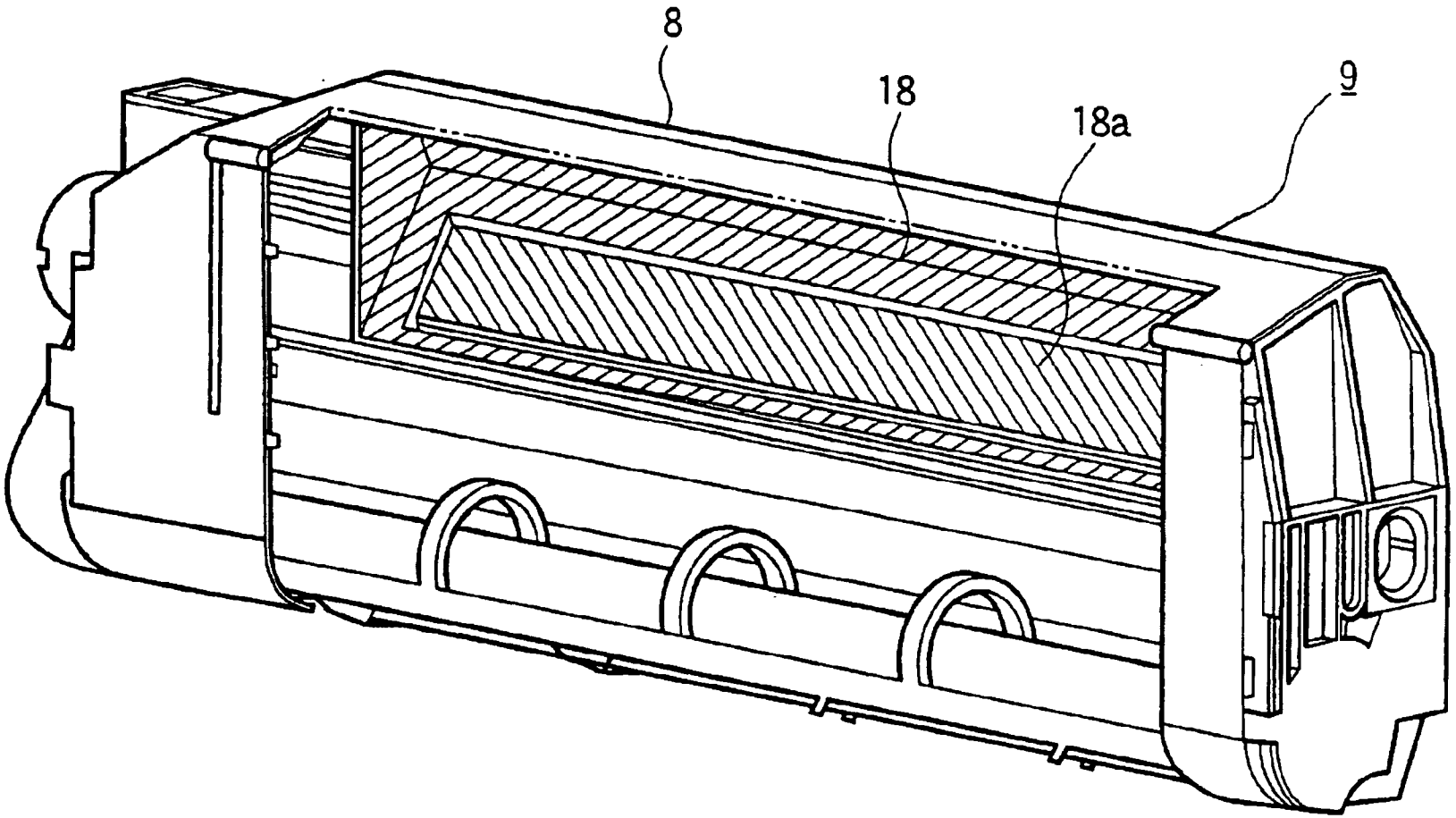
FIG. 2 is a perspective view of a toner cartridge according to a first embodiment.

FIG. 2 is a perspective view of a toner cartridge 9 according to a first embodiment.

Figure 3:
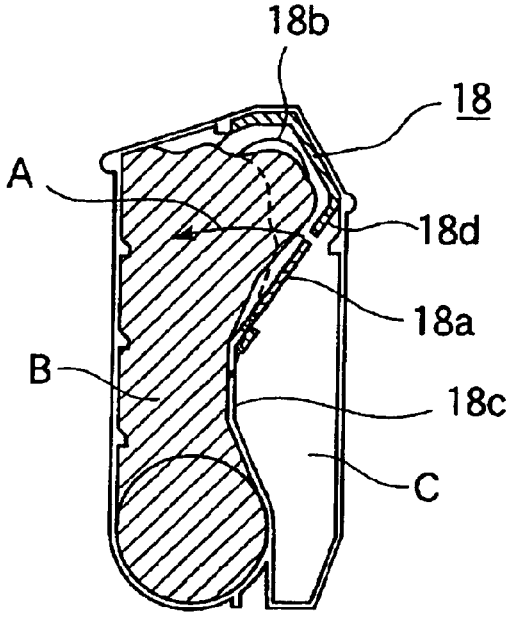
FIG. 3 is a cross-sectional view of the toner cartridge when it remains sealed.

FIG. 3 is a cross-sectional view of the toner cartridge 9 when it remains sealed.

Figure 4:
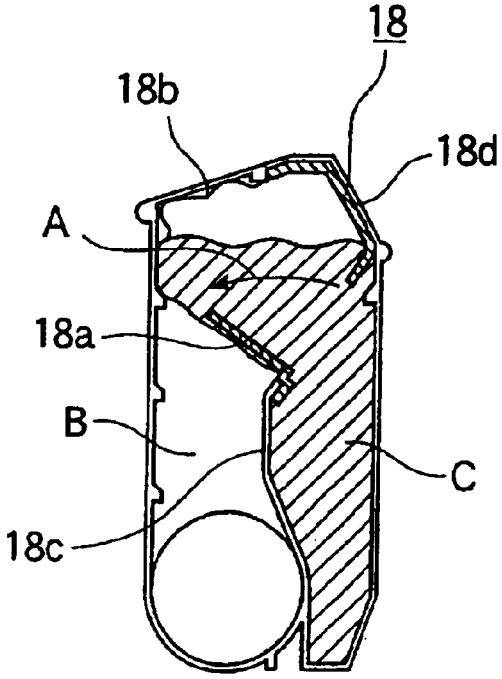
FIG. 4 is a cross-sectional view of a toner cartridge that has reached the end of its lifetime.

FIG. 4 is a cross-sectional view of a toner cartridge 9 that has reached the end of its lifetime.

Figure 5:
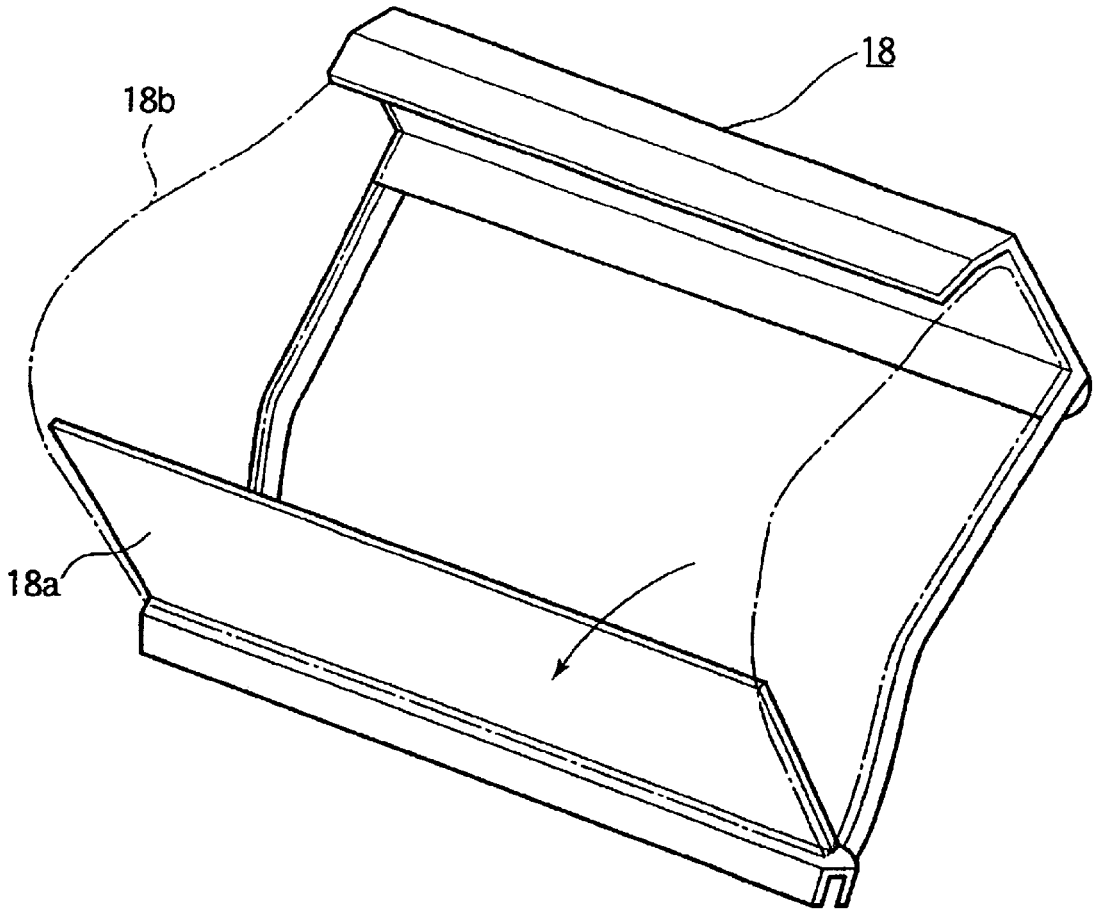
FIG. 5 is a perspective view, illustrating a movable partitioning mechanism having a bag-shaped deformable partition.

FIG. 5 is a perspective view, illustrating a movable partitioning mechanism 18 having a bag-shaped deformable partition 18*b*.

The toner cartridge 9 according to the embodiment will be described with reference to FIGS. 2–5. The toner cartridge 9 has a movable partitioning mechanism 18 that includes a swingable plate 18*a*, a bag-shaped deformable partition 18*b*, an upper partition wall 18*d*, and a lower partition wall 18*c*. The movable partitioning mechanism 18 divides an inner space of the toner cartridge 9 into a fresh toner chamber B and a waste toner chamber C.

The deformable partition 18*b* is disposed between the lower partition wall 18*c* near the swingable plate 18*a* and an upper portion of the upper partition wall 18*d*. The deformable partition 18*b* is fixed at its one end portion to the upper end of the upper partition wall 18*d* and at its other end to the upper end of the lower partition wall 18*c*. Thus, the deformable partition 18*b* defines the fresh toner chamber B and the waste toner chamber C that are sealed against each other, preventing the toner in the fresh toner chamber B from being mixed with the toner in the waste toner chamber C. The swingable plate 18*a* is pivotally mounted to the upper end of the lower partition wall 18*c*. As shown in FIG. 3, a spring, not shown, urges the swingable plate 18*a* in a direction shown by arrow A.

As printing is performed repeatedly, the fresh toner in the fresh toner chamber B decreases gradually. The residual toner on the photoconductive drum 8*a* is removed from the photoconductive drum 8*a* and collected into the waste toner chamber C by a toner collecting mechanism provided on a die frame, not shown. As the fresh toner decreases, the swingable plate 18*a* will be inclined gradually by the spring, not shown, in the direction shown by arrow A as shown in FIG. 3. As a result, the waste toner chamber C increases in volume.

The first embodiment has been described with respect to a case in which the waste toner chamber C gradually increases in volume as the amount of waste toner collected in the waste toner chamber C increases. A modification can be made such that when the amount of waste toner exceeds a certain value, the urging force of the spring is large enough to allow the swingable plate 18*a* to swing. The modification allows the volume of the waste toner chamber C to increase when no fresh toner is present in the fresh toner chamber B, preventing toner clump in the waste toner chamber C.

Second Embodiment

A second embodiment differs from the first embodiment in the interior structure of the toner cartridge 9.

Figure 6:
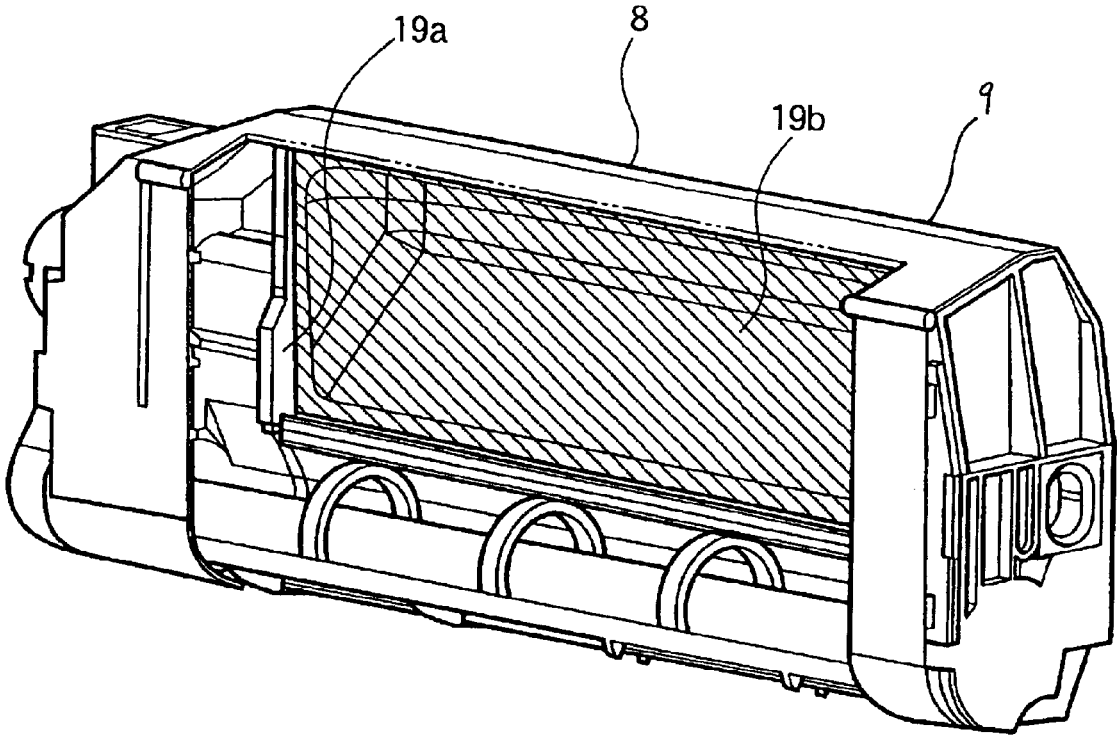
FIG. 6 is a perspective view of the toner cartridge according to a second embodiment.

FIG. 6 is a perspective view of the toner cartridge 9 according to the second embodiment.

Figure 7:
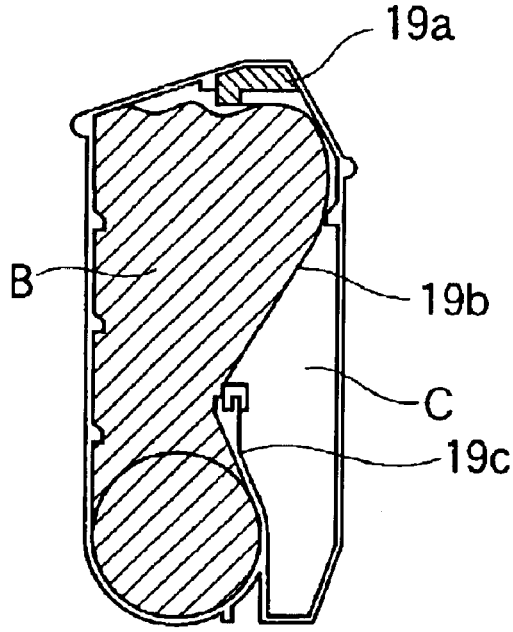
FIG. 7 is a cross-sectional view of the toner cartridge when it remains sealed.

FIG. 7 is a cross-sectional view of the toner cartridge 9 when it remains scaled.

Figure 8:
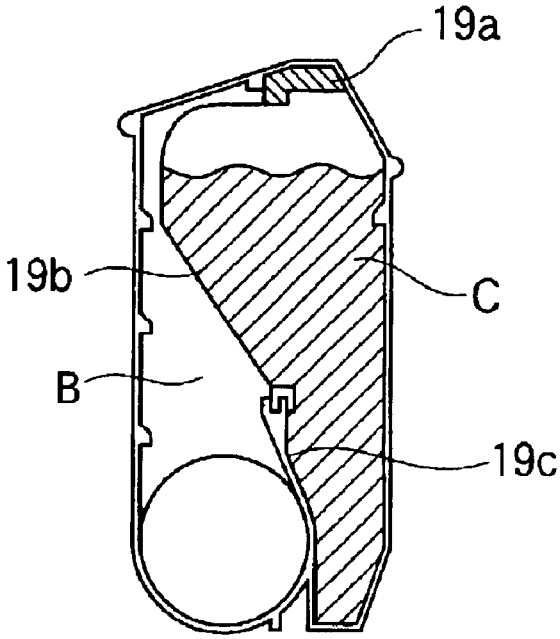
FIG. 8 is a cross-sectional view of the toner cartridge when it is empty of fresh toner.

FIG. 8 is a cross-sectional view of the toner cartridge 9 when it is empty of fresh toner.

Figure 9:
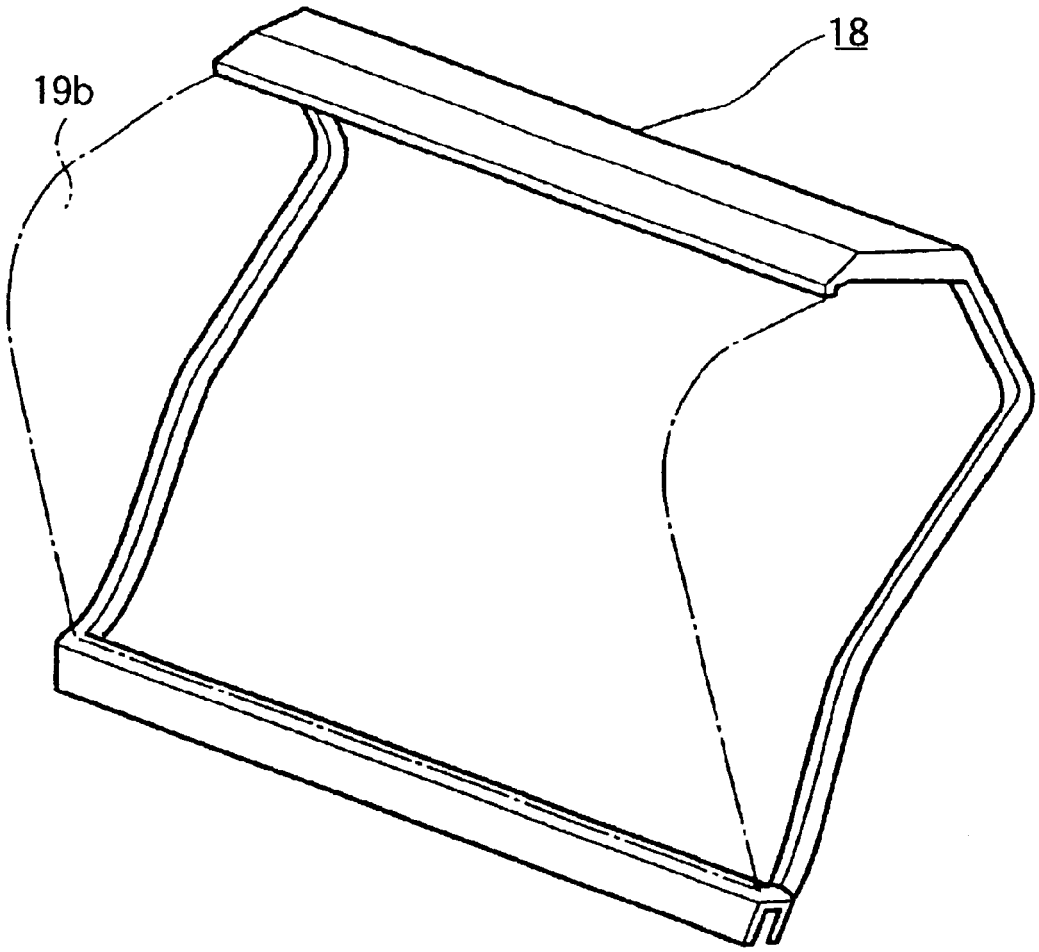
FIG. 9 is a perspective view of a movable partitioning mechanism having a bag-shaped deformable partition.

FIG. 9 is a perspective view of a movable partitioning mechanism 18 having a bag-shaped deformable partition 19*b*.

As shown in FIGS. 6–9, the toner cartridge 9 has a lower partitioning wall 19*c*, an upper partitioning wall 19*a*, and a bag-shaped deformable partition 19*b* that defines a fresh toner chamber B and a waste toner chamber C. The bag-shaped deformable partition 19*b*, upper partitioning wall 19*a*, and lower partitioning wall 19*c* are integral with one another so that a small force can cause the bag-shaped deformable partition 19*b* to displace toward the fresh toner chamber B or toward the waste toner chamber C.

When printing is performed repeatedly, the fresh toner in the fresh toner chamber B decreases gradually. The residual toner is removed from the photoconductive drum 8*a*, and is collected by the toner collecting mechanism into the waste toner chamber C. The waste toner collected into the waste toner chamber C is moved by a later described spiral shaft from near end to the far end in the waste toner chamber C. The waste toner is gathered toward the middle of the waste toner chamber C and applies pressure against the deformable partition 19*b*, so that the deformable partition or bag-shaped partition 19*b* is pushed by the waste toner toward the fresh toner chamber B. Thus, the waste toner chamber C increases in volume by an amount of the movement of the de formable partition 19*b*.

Figure 10:
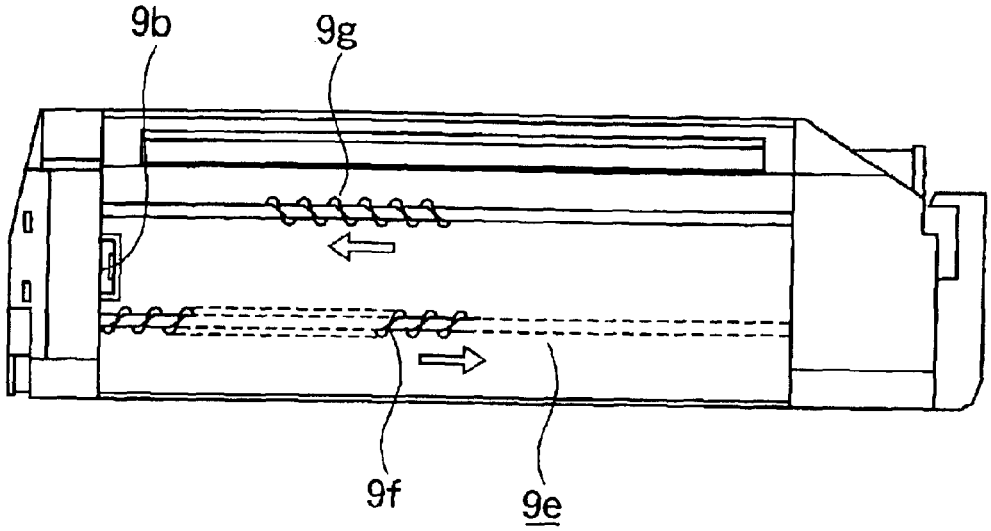
FIG. 10 is a cross-sectional side view, illustrating the interior of a toner cartridge according to the second embodiment.

FIG. 10 is a cross-sectional side view, illustrating the interior of a toner cartridge 9 according to the second embodiment.

Figure 11:
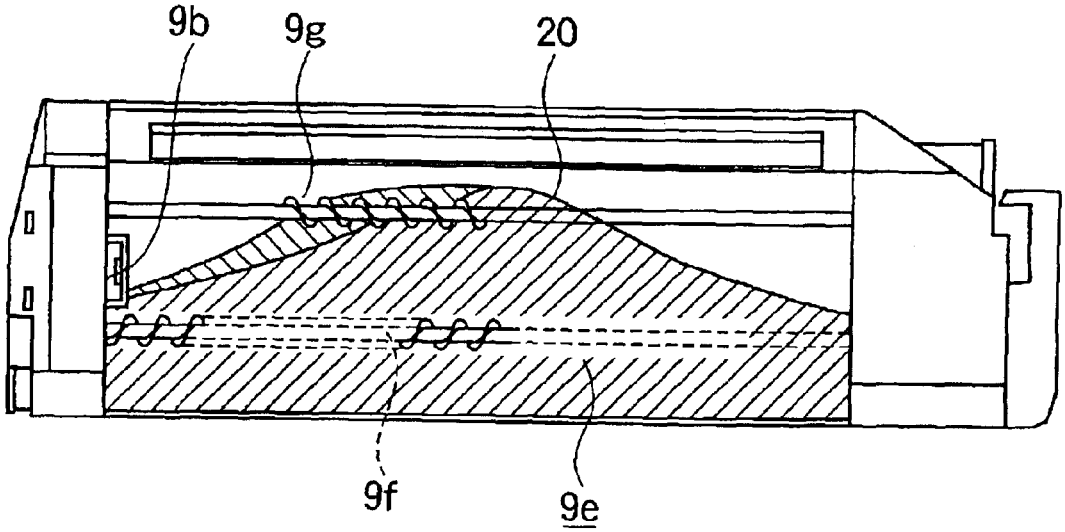
FIG. 11 is a cross-sectional view, illustrating the waste toner held in a waste toner chamber of the toner cartridge according to the second embodiment.

FIG. 11 is a cross-sectional view, illustrating the waste toner held in the waste toner chamber C of the toner cartridge 9 according to the second embodiment.

For efficient utilization of the space in the waste toner chamber C, a spiral shaft 9*e* is rotated to move a pile of waste toner 20 toward the middle of the waste toner chamber C. A conventional spiral shaft has a vane 9*f* that spans across the entire length of the spiral shaft 9*e* so as to move the waste toner to the end of waste toner chamber C. The spiral shaft 9*e* according to the second embodiment has the vane 9*f* shaft so that the bag-shaped deformable partition 19*b* efficiently deforms into the adjacent fresh toner chamber B. There is provided a spiral shaft 9*g* over the spiral shaft 9*e* and these two spiral shafts 9*e*, 9*g* rotate. The spiral shaft 9*g* has a vane that describes a spiral in the opposite direction to the spiral shaft 9*e*, the vane causing the top of the pile of the waste toner 20 to fall toward a waste toner inlet 9*b*.

During printing, the toner in the fresh toner chamber B is used in developing and residual toner is removed from the photoconductive drum 8*a* and collected by the toner collecting mechanism, not shown into the waste toner chamber C. The spiral shaft 9*e* causes the waste toner 20 in the waste toner chamber C to move to the end of the waste toner chamber C. Because the vane 9*f* extends only as far as the middle of spiral shaft 9*e*, the waste toner 20 begins to pile up at a longitudinal middle of the bag and the pile will grow there. As a result, the waste toner will produce a pressure that causes the bag to extend toward the fresh toner chamber B easily and the pile of the waste toner 20 to fall toward the waste toner inlet 9*b*. Thus, the waste toner 20 is distributed all over the floor in the waste toner chamber C, allowing efficient use of the toner holding space.

The deformable partition 19*b* that defines the boundary between the fresh toner chamber B and the waste toner chamber C deforms substantially uniformly across the length of the waste toner chamber C, ensuring that a space holding the waste toner 20 is enlarged. Because the collected waste toner 20 is distributed all over floor in the waste toner chamber C, a limited small space can be efficiently utilized.

Third Embodiment

Figure 12:
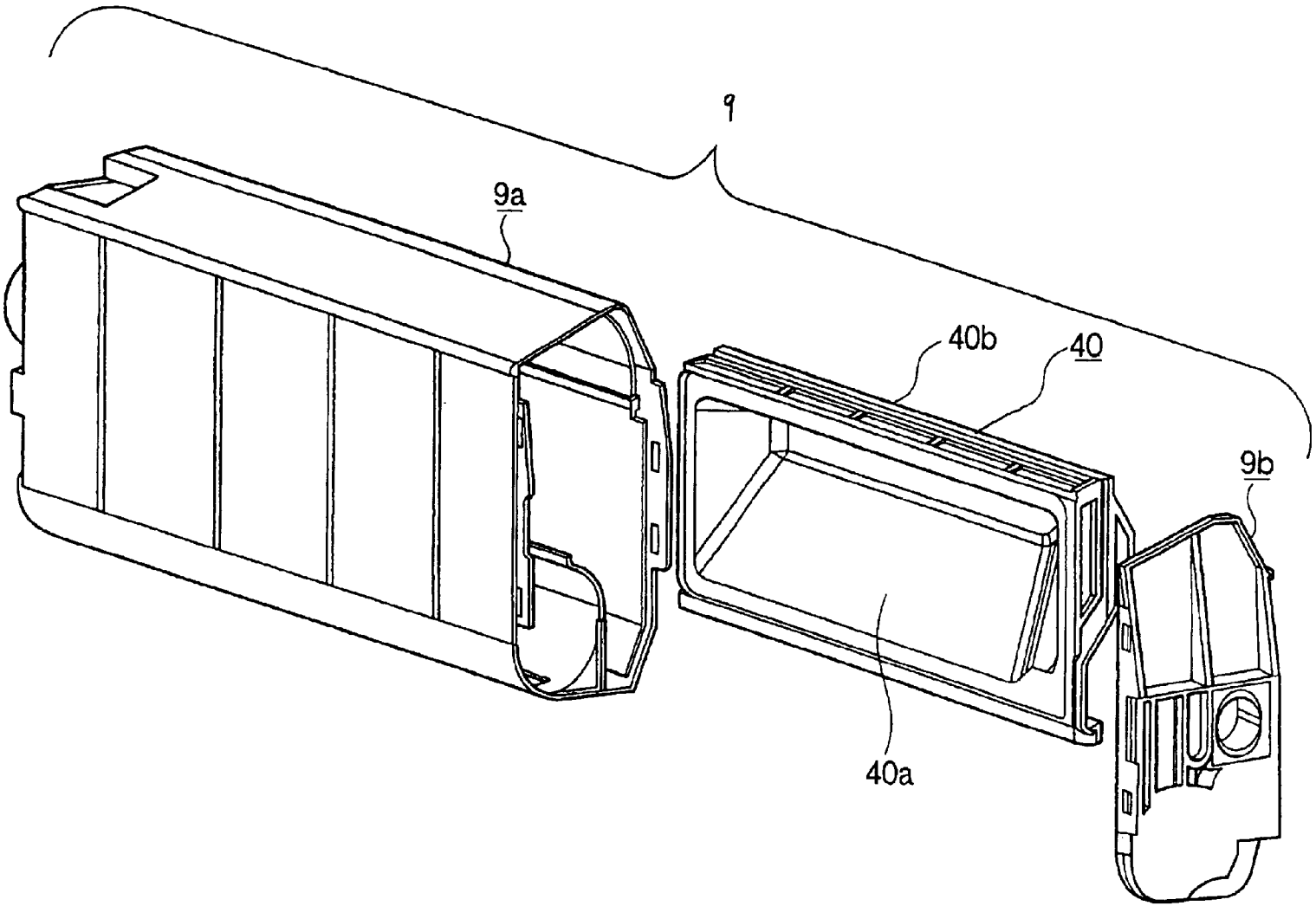
FIG. 12 is a perspective view, illustrating the general configuration of a toner cartridge according to a third embodiment.

FIG. 12 is a perspective view, illustrating the general configuration of a toner cartridge 9 according to a third embodiment.

Figure 13A:
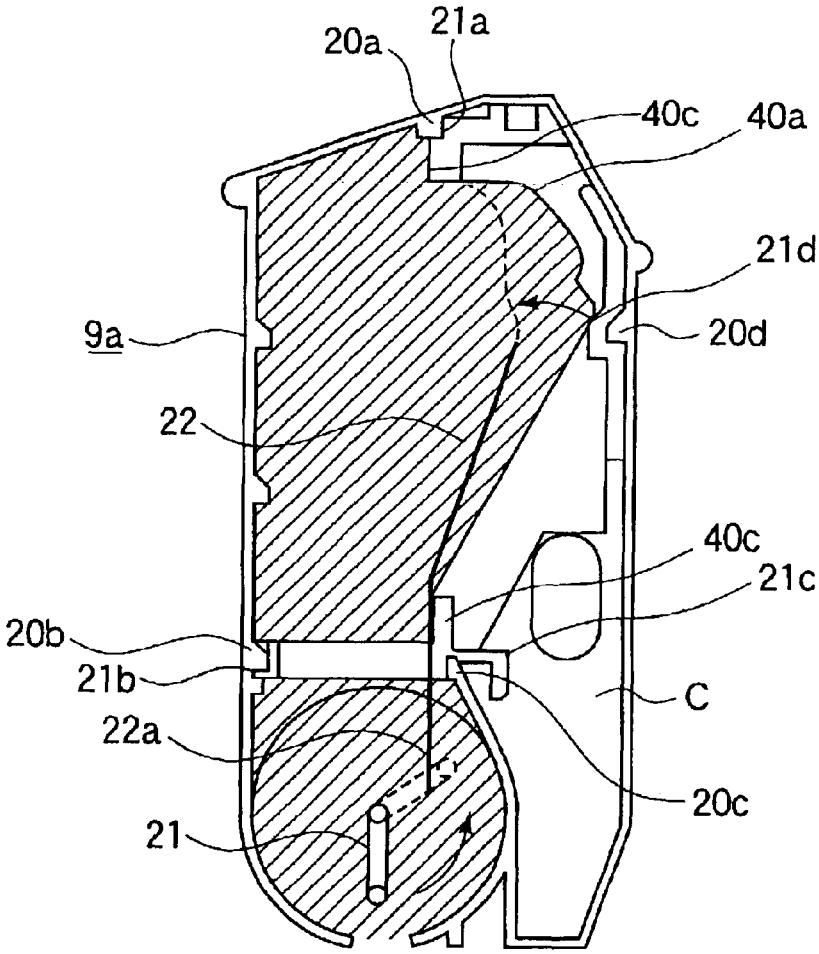
FIG. 13A is a cross-sectional view, illustrating the toner cartridge according to the third embodiment.

FIG. 13A is a cross-sectional view, illustrating the toner cartridge 9 according to the third embodiment.

Figure 13B:
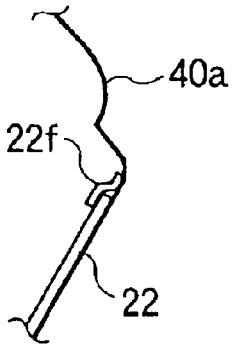
FIG. 13B is a fragmentary side view of a film and a bag-shaped deformable partition.

FIG. 13B is a fragmentary side view of a film and a bag-shaped deformable partition 40*a*.

As shown in FIG. 12, the toner cartridge 9 includes an outer case 9*a*, a movable partitioning mechanism 40 slidably assembled into the outer case 9*a*, and a side wall 9*b* that closes the side of the outer case 9*a*. The movable partitioning mechanism 40 has a bag-shaped deformable partition 40*a*, which is assembled in a unitary construction. When the movable partitioning mechanism 40 is slidably assembled into the outer case 9*a*, a fresh toner chamber B and waste toner chamber C are defined in the outer case 9*a* as shown in FIG. 13A. It is to be noted that the movable partitioning mechanism 40 can disassembled from the outer case 9*a* so that the movable partitioning mechanism 40 can be re-used by simply replacing a later described sealing member 24.

Figure 14:
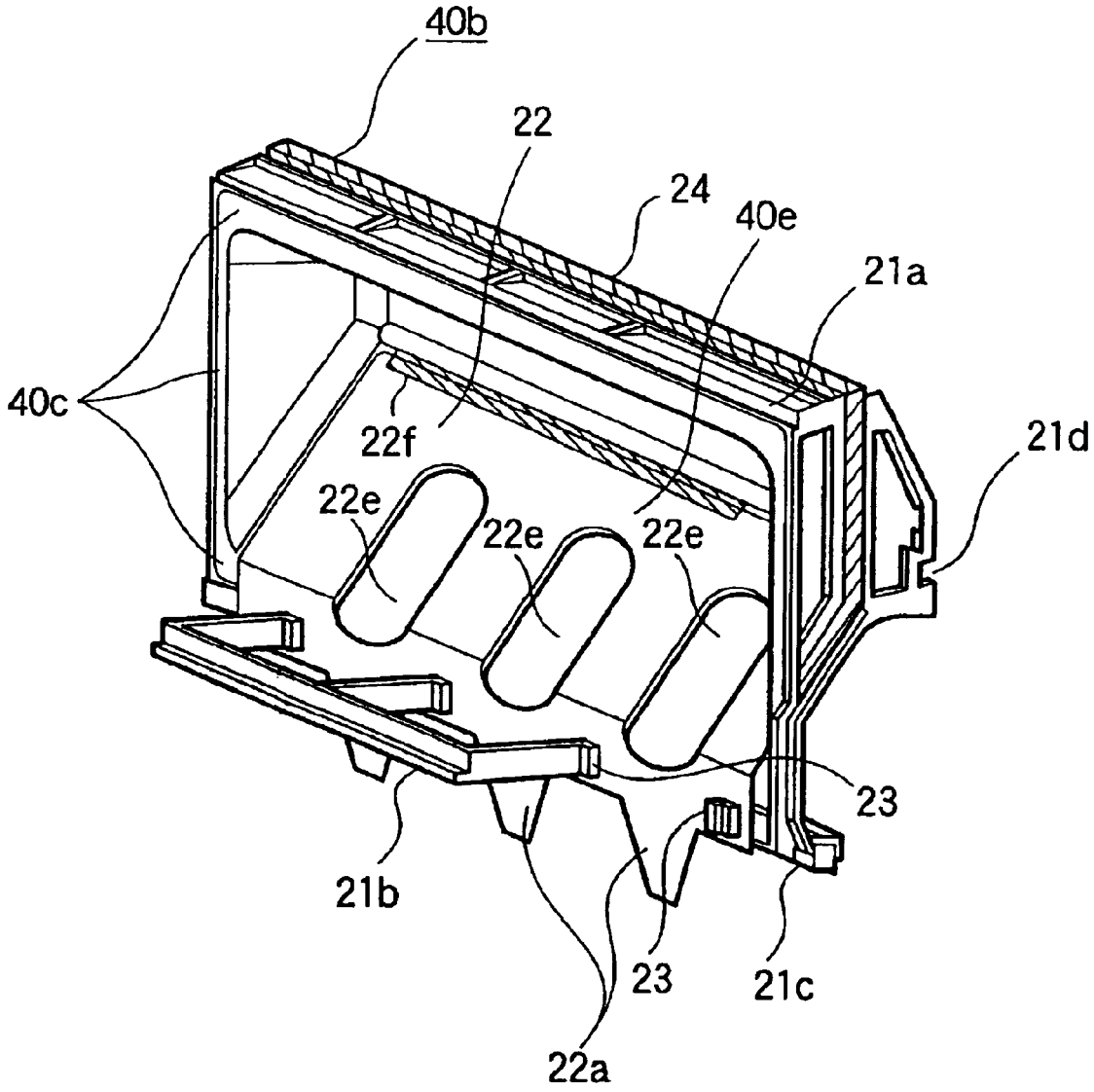
FIGS. 14 and 15 are expanded perspective views, illustrating the detail of a movable partitioning mechanism in FIG. 12.
Figure 15:
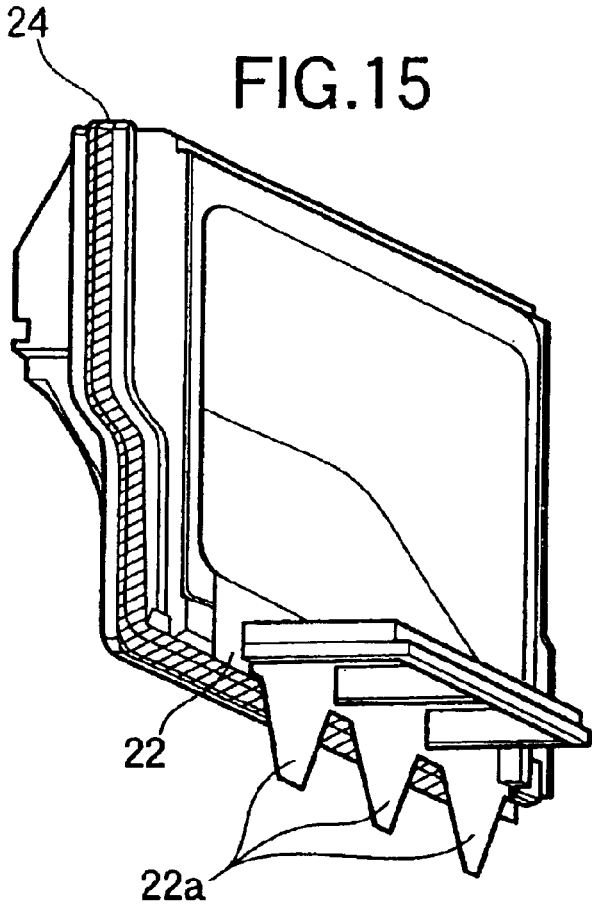

FIGS. 14 and 15 are expanded perspective views, illustrating the detail of the movable partitioning mechanism 40 in FIG. 12.

Figure 16:
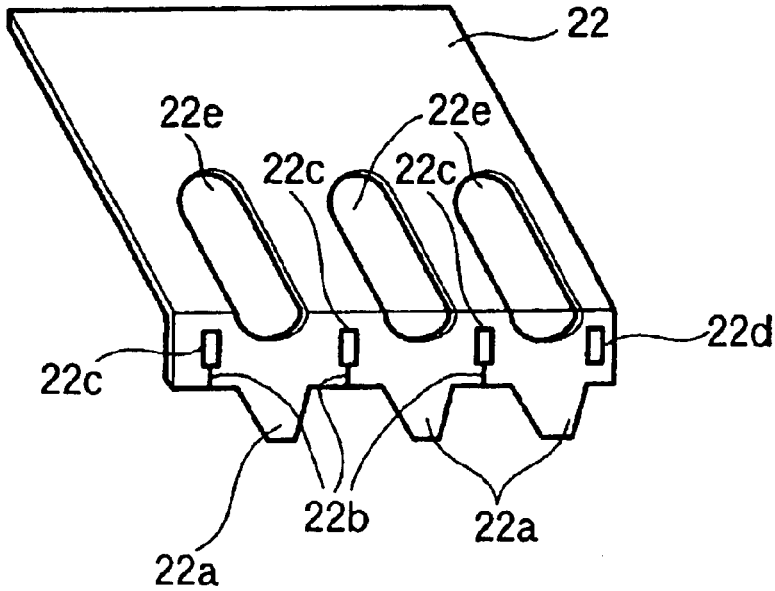
FIG. 16 is a perspective view of the film assembled into the movable partitioning mechanism.

FIG. 16 is a perspective view of the film 22 assembled into the movable partitioning mechanism 40.

Figure 17:
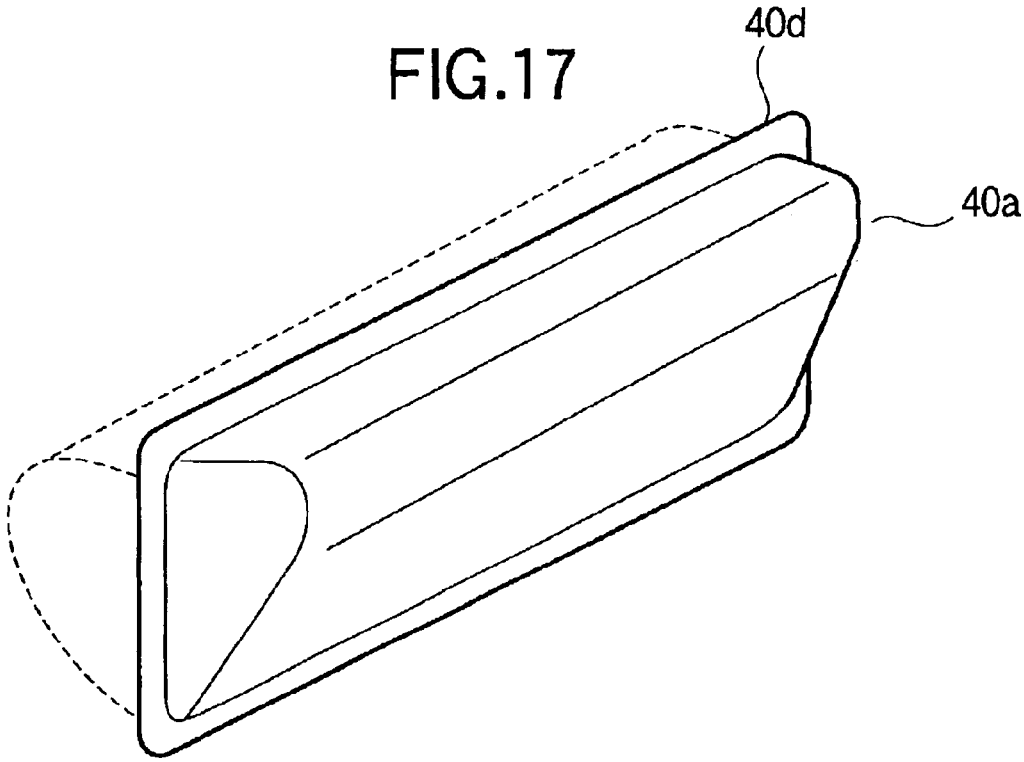
FIG. 17 is a perspective view, illustrating the deformable partition provided to the movable partitioning mechanism.

FIG. 17 is a perspective view, illustrating the deformable partition 40*a* provided to the movable partitioning mechanism 40.

The bag-shaped deformable partition 40*a* (FIG. 17) is inserted in a recess 40*e* (FIG. 14) formed in the movable partitioning mechanism 40. An outer peripheral portion 40*d* of the deformable partition 40*a* is welded to an end portion 40*c* (FIGS. 13A and 14) of the frame 40*b*. The deformable partition 40*a* defines the fresh toner chamber B and the waste toner chamber C. The movable partitioning mechanism 40 also has a film 22 having its tip attached to the bag-shaped deformable partition 40*a* by means of a tape 22*f* as shown in FIG. 13B and FIG. 14. The film 22 is movable with the bag-shaped deformable partition 40*a* in the direction shown by an arrow. The material and thickness of the deformable partition 40*a* are selected such that the deformable partition 40*a* can easily deform into the adjacent fresh toner chamber B. The deformable partition 40*a* is vacuum-molded from a sheet of polyethylene or polypropylene by using a concave mold. The thickness t of the deformable partition 40*a* is in the range of 0.2 mm≦t≦0.4 mm.

If the thickness t is such that t≦0.2 mm, there may be a large variation of thickness, making it difficult to properly mold the deformable partition 40*a* If the thickness t is in the relation that t>0.4 mm, the bag-shaped deformable partition 40*a* loses flexibility significantly to such an extent that a small pressure applied by the waste toner 20 is not enough to cause the bag-shaped deformable partition 40*a* to deform. Therefore, a sufficient amount of waste toner cannot be collected.

As shown in FIGS. 14 and 15, the frame 40*b* has an outer end on which a sealing member (sponge) 24 is provided, shown by hatching. The sealing member 24 seats between the outer end and the outer case 9*a* when the movable partitioning mechanism 40 is inserted into the toner cartridge 9. The sealing member 24 isolates the fresh toner chamber B from the waste toner chamber C completely, so that the toners in the chambers are not mixed with each other.

As shown in FIGS. 14 and 15, the frame 40*b* of the movable partitioning mechanism 40 has guides 21*a*–21*d*. As shown in FIG. 13A, there are provided guides 20*a*–20*d* on the inner wall surface of the outer case 9*a*. When the movable partitioning mechanism 40 is inserted into or pulled out of the outer case 9*a*, the aforementioned guides 21*a*–21*d* of the frame 40*b* engage the aforementioned guides 20*a*–20*d* of the outer case 9*a*, thereby allowing the outer case 9*c* to smoothly guide the frame 40*b*. Upon completion of insertion of the frame 40*b*, the frame 40*b* is accurately positioned in the outer case 9*a*.

The guides 21*a*–21*d* of the frame 40*b* serve to add mechanical strength to the frame 40*b*.

FIG. 17 illustrates the bag-shaped deformable partition 40*a* before it is attached to the movable partitioning mechanism 40. The deformable partition 40*a* has an outer peripheral portion 40*d* bonded to the frame 40*b* by an adhesive. As shown in FIG. 16, the film 22 has, three large holes 22*e*, three slits 22*b*, three holes 22*c*, and one hole 22*d*, which are fitted to guides 23 of the frame 40*b*. The film 22 is disposed on the inside of the fresh toner chamber B.

The film 22 is detachably mounted at a portion near tips 22*a* for reasons which will be described later. As shown in FIG. 13A, the tips 22 project into a rotational path of an agitator bar 21 to agitate the toner in the fresh toner chamber B. The film 22 is configured to the deformable partition 40*a*, i.e., the film 22 is bent as shown in FIGS. 15 and 16. As shown in FIG. 13A, the agitator bar 21 rotates to engage the tips 22*a*, causing the tips 22*a* to flex. The agitator bar 21 further rotates to subsequently release the tips 22*a*, so that the film 22 vibrates lightly in its entirety. The film 22 is mounted to the movable partitioning mechanism 40 in such a way that it will not come off the frame 40*b* when the agitator bar 21 continues to rotate, cycling to move into and out of engagement with the tips 22*a*.

As shown in FIG. 13A, the agitator bar 21 rotates in a direction shown by an arrow to agitate the toner, thereby supplying the toner to the developing unit, not shown, at all times. The film 22 is made of, for example, polyester and has a thickness tin the range of 0.05 mm≦t≦0.25 mm, and preferably t≦0.1 mm. A thickness t less than 0.05 mm cannot make the film 22 resilient enough to add vibration to the toner in the fresh toner chamber B when the tips 22*a* are released from the agitator bar 21. A thickness t greater than 0.25 mm makes the film 22 too rigid, so that the pressure given by the waste toner is not large enough to cause the deformable partition 40*a* to deform toward the fresh toner chamber B. Thus, the waste toner chamber C cannot hold a large amount of waste toner 20.

Because the film 22 is detachably mounted to the frame 40*b*, the film 22 can be disassembled for cleaning.

The toner cartridge 9 according to the third embodiment operates as follows: As printing is performed repeatedly, the fresh toner in the fresh toner chamber B is consumed gradually and the residual toner is removed from the photoconductive drum 8*a* and collected into the waste toner chamber C. The waste toner 20 in the waste toner chamber C is moved further into the waste toner chamber C by the spiral shaft 9*e* (FIG. 10). Thus, the waste toner 20 will pile up with its top located in the middle of the longitudinally extending waste toner chamber C. The pile of the waste toner 20 produces pressure to push the deformable partition 40*a* toward the fresh toner chamber B. As the waste toner 20 increases, the bag-shaped deformable partition 40*a* will extend toward the fresh toner chamber B as shown in FIG. 17, so that a larger amount of waste toner 20 can be held in the waste toner chamber C.

With the third embodiment, the opening, through which the waste toner is introduced into the waste toner chamber C, is located below a swelled portion of the bag-shaped deformable partition 40*a*. The deformable partition 40*a* is caused to extend toward the fresh toner chamber B after the waste toner 20 piles up in the waste toner chamber C. This feature will be described in more detail with reference to FIGS. 18–22.

Figure 18:
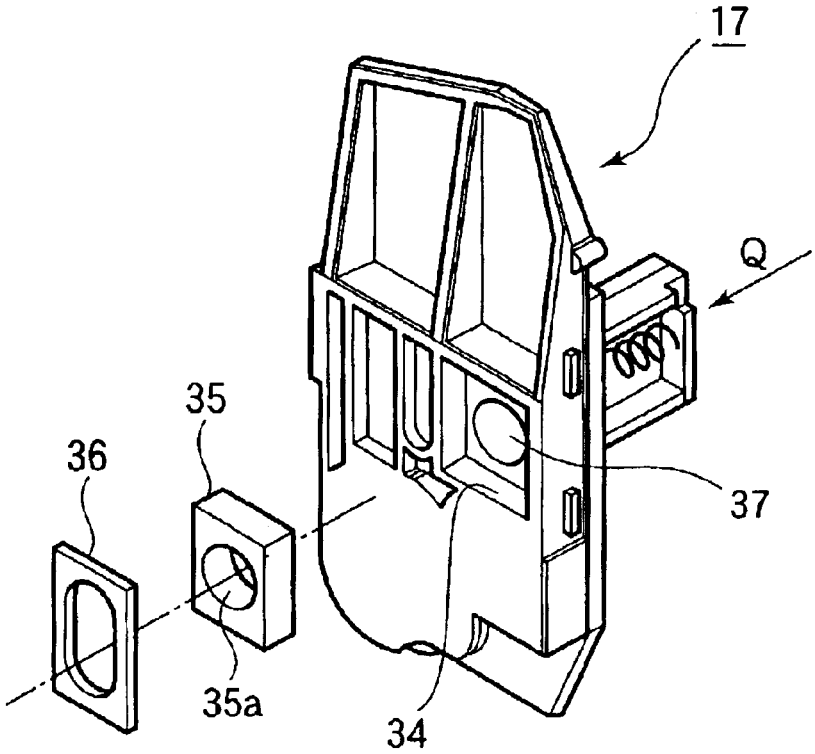
FIG. 18 is a perspective view of a side wall when the toner cartridge is seen from outside of the toner cartridge.

FIG. 18 is a perspective view of a side wall 17 when the toner cartridge 9 is seen from outside of the toner cartridge 9.

Referring to FIG. 18, there is provided a support 34 to surround an opening 37. The support 34 receives a resilient foaming sponge 35 having a thickness of several millimeters. An outer cover 36 is attached in the outer surface of the side wall 17, thereby preventing the foaming sponge 35 from disengaging from the side wall 17. The foaming sponge 35 has a hole 35*a* formed in the middle through which a toner discharging beak 42 enters into the waste toner chamber C through the opening 37. When the toner discharging beak 42 (FIG. 21) enters the opening 37, the foaming sponge 35 engages the toner discharging beak 42. This structure substantially eliminates the gap between the toner discharging beak 42 and the opening 37 which would otherwise cause the toner spillage from the toner cartridge 9 when the toner discharging beak 42 is pushed into the waste toner chamber C and pulled out of the waste toner chamber C.

Figure 19:
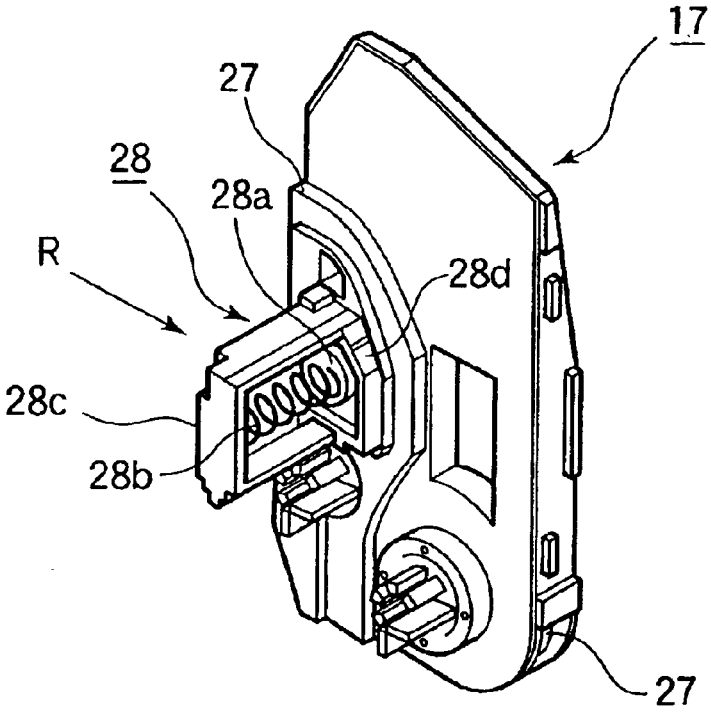
FIG. 19 is a perspective view of the side wall when the toner cartridge is seen in a direction shown by arrow Q in FIG. 18.

FIG. 19 is a perspective view of the side wall 17 when the toner cartridge 9 is seen in a direction shown by arrow Q in FIG. 18. FIG. 19 illustrates the opening 37 closed by an opening/closing member 28*a*, i.e., when the toner-discharging beak 42 is not pushed into the toner cartridge 9.

As shown in FIG. 19, an inner plate 27 is fixed to the inner surface of the side wall 17 by means of a fitting member, not shown. The inner plate 27 has an opening/closing mechanism 28 mounted thereto. The opening/closing mechanism 28 includes the opening/closing member 28*a* that closes the opening 37 from the inside of the toner cartridge 9, a frame 28*c* that movably holds the opening/closing member 28*a*, a spring 28*b* that urges the opening/closing member 28*a* outwardly, and a movable member 28*d* to which one end of the spring 28*b* is secured.

Figure 20:
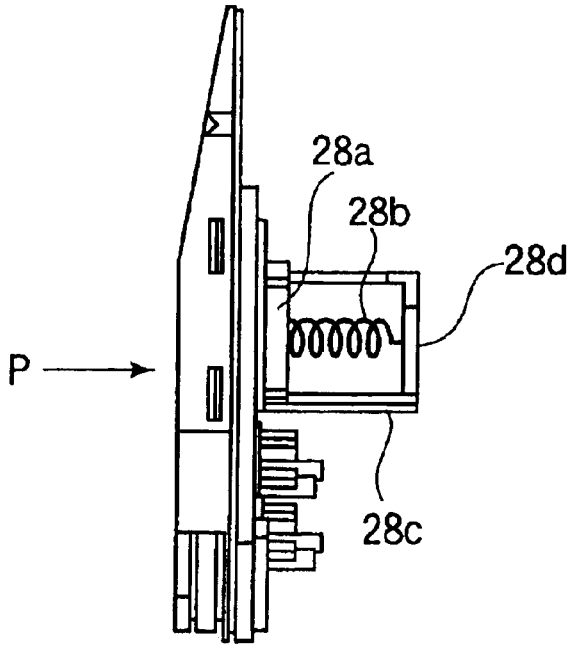
FIG. 20 is a side view when the side wall is seen from a direction shown by arrow R in FIG. 19.

FIG. 20 is a side view when the side wall 17 is seen from a direction shown by arrow R in FIG. 19.

Figure 21:
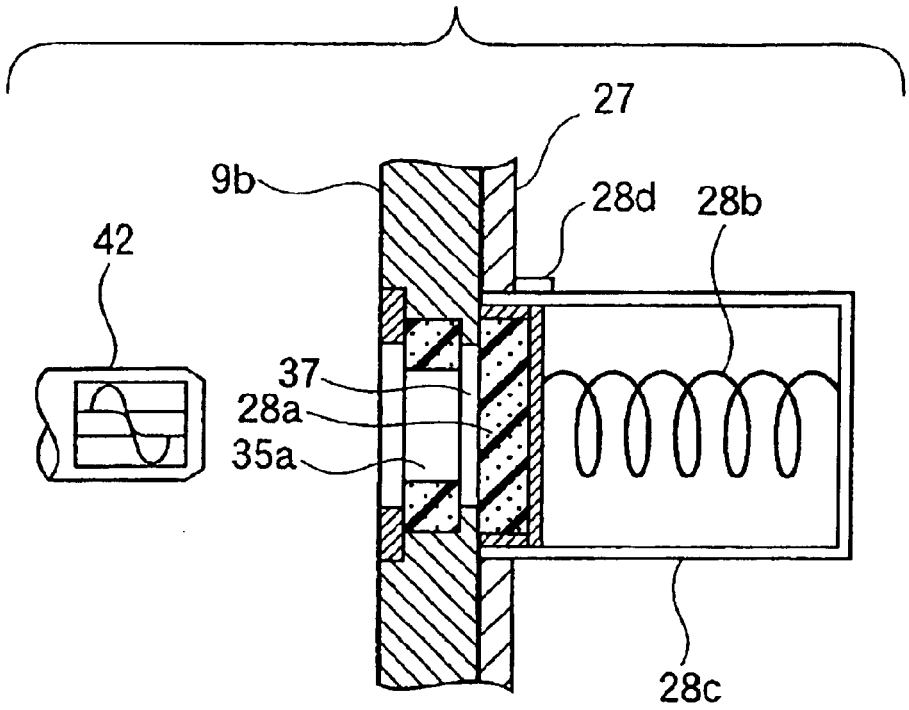
FIG. 21 illustrates the opening when it is closed by a opening/closing member.

FIG. 21 illustrates the opening 37 when the opening/closing member 28*a* closes the opening 37.

Figure 22:
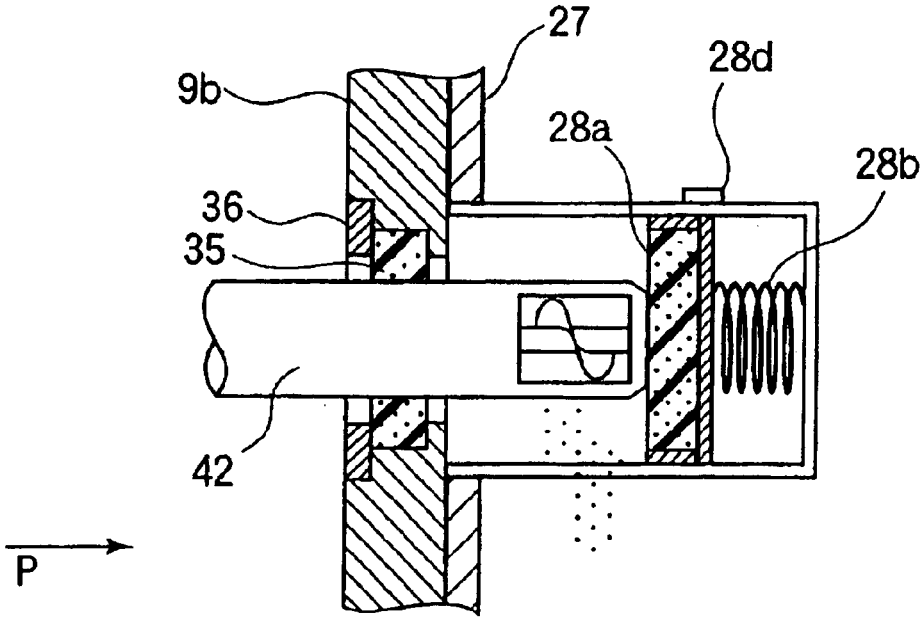
FIG. 22 illustrates the opening when it is opened.

FIG. 22 illustrates the opening 37 when it is opened.

As shown in FIG. 21, the opening 37 remains closed until the toner cartridge 9 has been attached to the image forming apparatus 1. When the toner cartridge 9 is attached to the image forming apparatus 1, the toner discharging beak 42 pushed the opening/closing member 28*a* in a direction shown by arrow P. The opening/closing member 28*a* moves along a slide against the urging force of the spring 28*b*, so that the toner transport path of the image forming apparatus 1 communicates with the waste toner chamber C of the toner cartridge 9. The toner-discharging beak 42 enters the waste toner chamber C by a predetermined distance and is maintained where it is. This ensures that the residual toner delivered to the toner cartridge 9 falls into the waste toner chamber C.

When the toner cartridge 9 is detached from the image forming apparatus 1, the toner discharging beak 42 is withdrawn from the opening 37, so that the opening/closing member 28*a* is urged by the spring 28*b* to close the opening 37. Thus, the toner in the waste toner chamber C will not leak.

The opening 37 through which the waste toner chamber C receives the residual toner is located below the bag-shaped deformable partition 40*a*. Therefore, the waste toner chamber C can be disposed as close to the image forming section below the toner cartridge 9 as possible. This configuration provides a shorter toner-transporting path, reducing the possibility of waste toner being clogged in the toner-transporting path.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A toner cartridge having a first chamber that holds fresh toner and a second chamber that holds waste toner, comprising:

a partition provided in the toner cartridge to divide an inner space of the toner cartridge into the first chamber and the second chamber, said partition having a movable portion and a fixed portion;

wherein said partition operates in such a way that a volume of the second chamber increases in accordance with an amount of the waste toner in the second chamber after the amount of the waste toner exceeds a predetermined value.

2. The toner cartridge according to claim 1, wherein said partition is such that the first chamber and the second chamber extend substantially in parallel with each other and are partially adjacent to each other horizontally.

3. The toner cartridge according to claim 1, wherein said partition operates in such a way that the first chamber decreases in volume and the second chamber increases in volume.

4. The toner cartridge according to claim 1, wherein said partition operates to increase the second chamber in volume when the amount of waste toner exceeds a certain value.

5. A toner cartridge having a first chamber that holds fresh toner and a second chamber that holds waste toner, comprising:

a partition provided in the toner cartridge to divide an inner space of the toner cartridge into the first chamber and the second chamber, said partition having a movable portion and a fixed portion that supports the movable portion, wherein the second chamber has a waste toner inlet located under the movable portion, said second chamber receiving the waste toner through the waste toner inlet;

wherein said partition operates in such a way that a volume of the second chamber increases in accordance with an amount of the waste toner in the second chamber.

6. The toner cartridge according to claim 5, wherein the movable portion is a deformable bag-shaped member.

7. The toner cartridge according to claim 6, wherein the bag-shaped member has a thickness in the range of 0.2 to 0.4 mm.

8. The toner cartridge according to claim 6, wherein the second chamber has a swingable member therein, the swingable member being urged against the partition in such a way that the swingable member pushes the deformable bag-shaped member toward the first chamber.

9. A toner cartridge having a first chamber that holds fresh toner and a second chamber that holds waste toner, comprising:

a partition provided in the toner cartridge to divide an inner space of the toner cartridge into the first chamber and the second chamber, said partition being detachably inserted into the toner cartridge;

wherein said partition operates in such a way that a volume of the second chamber increases in accordance with an amount of the waste toner in the second chamber.

10. A toner cartridge having a first chamber that holds fresh toner and a second chamber that holds waste toner, comprising:

a partition provided in the toner cartridge to divide an inner space of the toner cartridge into the first chamber and the second chamber, the first chamber having a resilient flap extending in the first chamber;

wherein said partition operates in such a way that a volume of the second chamber increases in accordance with an amount of the waste toner in the second chamber.

11. The toner cartridge according to claim 10, wherein the first chamber has an agitator bar that agitates the fresh toner in the first chamber, wherein the resilient flap is a film, wherein when the agitator bar agitates the fresh toner, the film moves into engagement with the agitator bar such that the film flexes and subsequently moves out of engagement with the agitator bar.

12. A toner cartridge having a first chamber that holds fresh toner and a second chamber that holds waste toner, comprising:

a partition provided in the toner cartridge to divide an inner space of the toner cartridge into the first chamber and the second chamber, wherein the second chamber extends in a longitudinal direction and has a first transport member therein and a waste toner inlet located at one of opposing ends of the second chamber, the first transport member extending in the longitudinal direction of the second chamber to transport the waste toner from one of the opposing ends of the second chamber to another one of the opposing ends;

wherein said partition operates in such a way that a volume of the second chamber increases in accordance with an amount of the waste toner in the second chamber.

13. The toner cartridge according to claim 12, wherein the first transport member has a spiral vane formed on it, the spiral vane extending from one end of the first transport member to a part of the first transport member.

14. The toner cartridge according to claim 13, wherein the second chamber includes a second transport member therein for transporting the waste toner toward the waste toner inlet, the second transport member extending above the first transport member in the longitudinal direction of the second chamber.

15. An image forming apparatus having a toner cartridge that includes a first chamber that holds fresh toner and a second chamber that holds waste toner, the toner cartridge comprising:

a partition provided in the toner cartridge to divide an inner space into the first chamber and the second chamber, said partition having a movable portion and a fixed portion;

wherein said partition operates in such a way that a volume of the second chamber increases in accordance with an amount of the waste toner in the second chamber after the amount of the waste toner exceeds a predetermined value.

16. The image forming apparatus according to claim 15, wherein said partition has a movable portion and a fixed portion that supports the movable portion, wherein the second chamber has a waste toner inlet through which the second chamber receives the waste toner, the waste toner inlet being located under the movable portion.

17. The image forming apparatus according to claim 16, wherein the movable portion is a deformable bag-shaped member.

18. The image forming apparatus according to claim 17, wherein the bag-shaped member has a thickness in the range of 0.2 to 0.4 mm.

19. The image forming apparatus according to claim 15, wherein said partition operates in such a way that the first chamber decreases in volume and the second chamber increases in volume.

20. An image forming apparatus having a toner cartridge that includes a first chamber that holds fresh toner and a second chamber that holds waste toner, the toner cartridge comprising:

a partition provided in the toner cartridge to divide an inner space into the first chamber and the second chamber, said partition having a deformable bag-shaped member having a thickness in the range of 0.2 to 0.4 mm and a fixed portion that supports the deformable bag-shaped member, wherein the second chamber has a waste toner inlet located under the deformable bag-shaped member, the second chamber receiving the waste toner through the waste toner inlet;

wherein said partition operates in such a way that a volume of the second chamber increases in accordance with an amount of the waste toner in the second, chamber.

21. An image forming apparatus having a toner cartridge that includes a first chamber that holds fresh toner and a second chamber that holds waste toner, the toner cartridge comprising:

a partition provided in the toner cartridge to divide an inner space into the first chamber and the second chamber, said partition being detachably inserted into the toner cartridge;

wherein said partition operates in such a way that a volume of the second chamber increases in accordance with an amount of the waste toner in the second chamber.

22. An image forming apparatus having a toner cartridge that includes a first chamber that holds fresh toner and a second chamber that holds waste toner, the toner cartridge comprising:

a partition provided in the toner cartridge to divide an inner space into the first chamber and the second chamber, the first chamber having a resilient flap extending in the first chamber;

wherein said partition operates in such a way that a volume of the second chamber increases in accordance with an amount of the waste toner.

23. The image forming apparatus according to claim 22, wherein the first chamber has an agitator bar that agitates the fresh toner in the first chamber, wherein the resilient flap is a film, wherein when the agitator bar agitates the fresh toner, the film moves into engagement with the agitator bar such that the film flexes, and subsequently moves out of engagement with the agitator bar.

24. An image forming apparatus having a toner cartridge that includes a first chamber that holds fresh toner and a second chamber that holds waste toner, the toner cartridge comprising:

a partition provided in the toner cartridge to divide an inner space into the first chamber and the second chamber, wherein the second chamber extends in a longitudinal direction and has a first transport member therein and a waste toner inlet located at one of opposing ends of the second chamber, the first transport member extending in the longitudinal direction of the second chamber to transport the waste toner from one of the opposing ends of the second chamber to another one of the opposing ends;

wherein said partition operates in such a way that a volume of the second chamber increases in accordance with an amount of the waste toner in the second chamber.

25. The image forming apparatus according to claim 24, wherein the first transport member has a spiral vane formed on it, the spiral vane extending from one end of the first transport member to a part of the first transport member.

26. The image forming apparatus according to claim 25, wherein the second chamber includes a second transport member therein for transporting the waste toner toward the waste toner inlet, the second transport member extending above the first transport member in the longitudinal direction of the second chamber.

* * * * *